US010556142B2

(12) United States Patent
Stein

(10) Patent No.: US 10,556,142 B2
(45) Date of Patent: Feb. 11, 2020

(54) CORE MUSCLE EXERCISE SYSTEM

(71) Applicant: Ken Shubin Stein, New York, NY (US)

(72) Inventor: Ken Shubin Stein, New York, NY (US)

( * ) Notice: Subject to any disclaimer, the term of this patent is extended or adjusted under 35 U.S.C. 154(b) by 0 days.

(21) Appl. No.: 15/701,638

(22) Filed: Sep. 12, 2017

(65) Prior Publication Data

US 2019/0076689 A1 Mar. 14, 2019

(51) Int. Cl.
*A63B 21/00* (2006.01)
*A63B 21/002* (2006.01)
(Continued)

(52) U.S. Cl.
CPC ..... *A63B 21/0023* (2013.01); *A63B 21/068* (2013.01); *A63B 21/4047* (2015.10);
(Continued)

(58) Field of Classification Search
CPC . A63B 4/00; A63B 21/0004; A63B 21/00047; A63B 21/0005; A63B 21/00054; A63B 21/00058; A63B 21/00069; A63B 21/00072; A63B 21/00076; A63B 21/00178; A63B 21/00181; A63B 21/00185; A63B 21/002; A63B 21/0023; A63B 21/0615; A63B 21/0616; A63B 21/0617; A63B 21/0618; A63B 21/065; A63B 21/068; A63B 21/0722; A63B 21/08; A63B 21/15; A63B 21/159; A63B 21/4023; A63B 21/4027; A63B 21/4029; A63B 21/4031; A63B 21/4033; A63B 21/4034; A63B 21/4035; A63B 21/4043; A63B 21/4045; A63B 21/4047; A63B 21/4049; A63B 22/0046; A63B 22/0048; A63B 22/14; A63B 22/16; A63B 22/18; A63B 22/20; A63B 22/201; A63B 22/203; A63B 22/205; A63B 23/02; A63B 23/0205; A63B 23/0211; A63B 23/0216; A63B 23/0222; A63B 23/0233; A63B 23/0238; A63B 23/035; A63B 23/03516; A63B 23/03525; A63B 23/03575; A63B 23/04; A63B 23/12; A63B 23/1236; A63B 26/00;
(Continued)

(56) References Cited

U.S. PATENT DOCUMENTS 5,403,256 A * 4/1995 Squires ..... A63B 9/00 482/148
7,637,851 B1 * 12/2009 Lormil ..... A63B 23/12 482/141
(Continued)

*Primary Examiner* — Gary D Urbiel Goldner
(74) *Attorney, Agent, or Firm* — Antonio Papageorgiou; Meister Seelig & Fein LLP

(57) ABSTRACT

An exercise system is provided for enabling a user to perform therewith a modified plank exercise, the exercise system includes: a top element having an interface for the user to hold or rest thereon; and a bottom element having an interface with a ground surface, the top and bottom elements interconnected and separated from each other with a middle element. At least one of the top and bottom elements is interchangeably coupled to the middle element, and the exercise system includes at least one element of instability that is overcome by involving core muscles of the user.

17 Claims, 5 Drawing Sheets

(51) Int. Cl.
*A63B 21/068* (2006.01)
*A63B 23/02* (2006.01)

(52) U.S. Cl.
CPC ..... *A63B 23/0205* (2013.01); *A63B 23/0233* (2013.01); *A63B 23/0238* (2013.01); *A63B 2225/093* (2013.01)

(58) Field of Classification Search
CPC ..... A63B 26/003; A63B 69/0057; A63B 71/0054; A63B 71/023; A63B 71/04; A63B 2071/0063; A63B 2071/0072; A63B 2071/0081; A63B 2071/026; A63B 2071/027; A63B 2208/02; A63B 2208/0271; A63B 2208/0276; A63B 2208/028; A63B 2208/0295; A63B 2210/50; A63B 2210/58; A63B 2225/09; A63B 2225/093
See application file for complete search history.

(56) References Cited

U.S. PATENT DOCUMENTS 7,806,807 B2 * 10/2010 Genua ..... A63B 21/0004 482/146
8,088,052 B1 * 1/2012 Sprague ..... A63B 21/0004 482/131
8,105,219 B1 * 1/2012 Sloan ..... A63B 21/0085 482/130
8,591,383 B1 * 11/2013 Mcalpin ..... A47L 23/16 482/23
9,079,056 B1 * 7/2015 McAlpin ..... A63B 4/00
9,533,191 B2 * 1/2017 Carbone ..... A63B 26/003
2001/0004624 A1 * 6/2001 Cournoyer ..... A63B 21/068 482/141
2003/0017922 A1 * 1/2003 Sachs ..... A63B 26/003 482/146
2004/0087421 A1 * 5/2004 Lin ..... A63B 21/0004 482/146
2009/0137372 A1 * 5/2009 Gates ..... A63B 21/078 482/142
2014/0011648 A1 * 1/2014 Carney ..... A63B 21/00181 482/142
2014/0011649 A1 * 1/2014 Carney ..... A63B 26/00 482/142
2014/0162848 A1 * 6/2014 Fuller ..... A63B 69/06 482/72
2015/0151159 A1 * 6/2015 Davidow ..... A63B 23/025 482/91
2016/0067546 A1 * 3/2016 Hunter, Jr. ..... A63B 23/1236 482/141
2017/0014666 A1 * 1/2017 Sather ..... A63B 23/0205
2017/0304675 A1 * 10/2017 Panes ..... A63B 23/0244

* cited by examiner

CORE MUSCLE EXERCISE SYSTEM

The present application relates to exercise systems and more particularly exercise systems for strengthening core muscles.

Various exercise systems exist for strengthening core muscles (e.g., abdominal, back, etc.). Some, such as the abdominal roller, are exercise specific and thus have limited uses. Others, such as the sit-up/hyper back extension benches, although not limited to one specific exercise, are still limited. More importantly, these types of equipment presume a certain minimum level of user functioning and thus do not account for individuals that are fit less than this minimum or that may be afflicted with an injury or impairment (e.g., of the back or neck) the prevents their use. Accordingly, there is a need for an exercise system that is not so limited.

SUMMARY OF THE INVENTION

In one aspect, an exercise system is provided for enabling a user to perform therewith a modified plank exercise, the system includes: a top element having an interface for a user to hold or rest thereon; and a bottom element having an interface with the ground, the top and bottom elements interconnected and separated from each other with a middle element. At least one of the top and bottom elements is interchangeably coupled to the middle element, and the system includes at least one element of instability that is overcome by involving a user's core muscles.

In at least one embodiment, the middle element is telescopically coupled to the top and bottom elements to adjustably separate the top and bottom elements from each other between a first position and a second position in which the user's bodyweight orthogonal to the user's back is lessened by between about 0% to about 100%, respectively.

In at least one embodiment, the system is provided as a modular kit with interchangeable components that vary a degree of instability of the exercise system.

In at least one embodiment, the kit comprises a first bottom element and a second bottom element, where the first bottom element has an instability that is different than an instability of the second bottom element.

In at least one embodiment, the first bottom element is stable at equilibrium and where the second bottom element is unstable at equilibrium.

In at least one embodiment, the first bottom element has a planar interface with the ground.

In at least one embodiment, the second bottom element has a curved interface with the ground.

In at least one embodiment, the second bottom element has a pivotal interface with the ground.

In at least one embodiment, the first bottom element has a semi-spherical or ellipsoidal shape.

In at least one embodiment, the first bottom element has a conical shape.

In at least one embodiment, the first bottom element is stable at equilibrium in a first axis of an orthogonal plane and unstable at equilibrium in a second axis of the orthogonal plane.

In at least one embodiment, the first bottom element has a semi-spherical or ellipsoidal shape interfacing with the ground.

In at least one embodiment, the element of instability comprises a pivotal connection between at least one of the top and bottom elements, and the middle element.

In at least one embodiment, the element of instability comprises at least one wheel or caster disposed at the bottom element.

In at least one embodiment, the top element comprises a platform with a plurality of handles located thereon.

In at least one embodiment, the top element comprises a platform with means for attaching accessories to the platform.

In at least one embodiment, the system includes at least one accessory adjustably coupled to the means for attaching accessories to the platform.

In another aspect, an exercise system is provided for enabling a user to perform therewith a modified plank exercise, the system includes: a top element having an interface for a user to hold or rest thereon; and a plurality of bottom elements each having an interface with the ground, the top and the plurality of bottom elements interchangeably interconnectable to a telescopic middle element, the middle element operable to adjustably separate the top and at least one of the plurality of bottom elements from the top element between a first position and a second position, where a first of the plurality of bottom elements has an instability that is different than an instability of a second of the plurality of bottom elements.

In another aspect an exercise system is provided for enabling a user to perform therewith a modified plank exercise, the system includes: a top element having an interface for a user to hold or rest thereon; a telescopic middle element pivotally coupled at a top end of the middle element to the top element; and a plurality of bottom elements each having an interface with the ground, the plurality of bottom elements interchangeably interconnectable to the middle element, the middle element operable to adjustably separate the top and at least one of the plurality of bottom elements from the top element between a first position and a second position, where a first of the plurality of bottom elements has an instability that is different than an instability of a second of the plurality of bottom elements.

In at least one embodiment, the first of the plurality of bottom element has a planar interface with the ground and the second of the plurality of bottom elements have a curved interface with the ground.

Additional aspects of the present invention will be apparent in view of the description which follows.

DETAILED DESCRIPTION OF THE INVENTION

Figure 2:
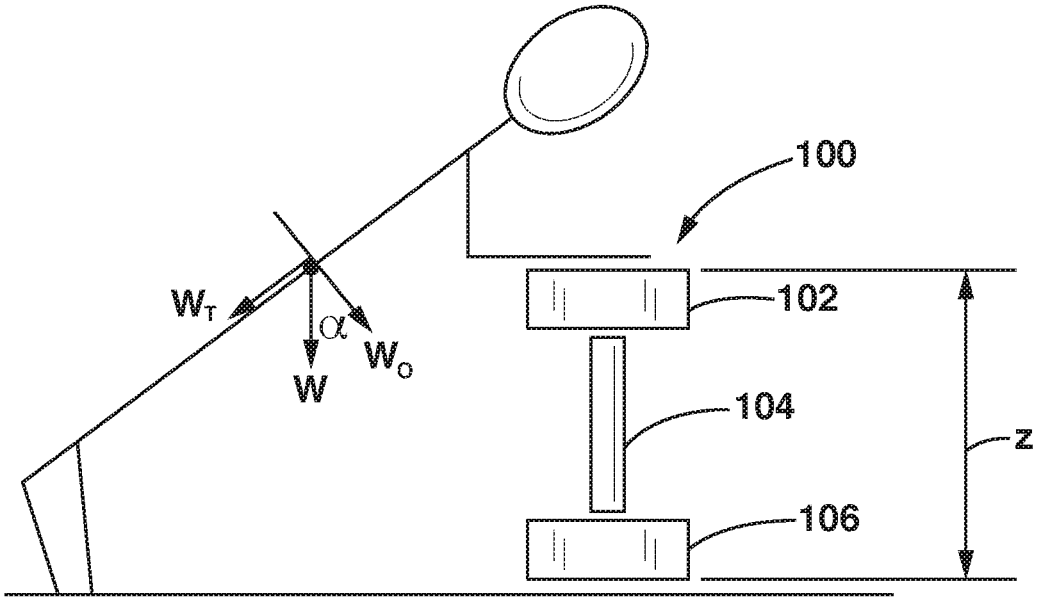
FIG. 2 is a side view depicting a representative use of the core muscle exercise system(s) disclosed herein.

The present application generally provides an exercise system for strengthening core muscles, which has a difficulty that is progressively adjustable (as discussed in greater detail below) to accommodate users having minimal fitness and/or a physical injury or impairment that would otherwise be unable to perform exercises targeting the core muscles. The exercise system is primarily designed to be used to modify traditional bodyweight exercises, such as the forearm plank, as shown in FIG. 2. The forearm plank is generally executed by lying on the floor with elbows and forearms flat against the floor and the torso raised to form a straight between the shoulders and ankles. Variations include the standard, knee and side planks. As can be appreciated, an individual with a back injury, for example, can have great difficulty even assuming the initial position of such bodyweight exercises. The exercise system of the present application generally varies the difficulty by lessening the user's bodyweight orthogonal to the user's back from between about 0% to about 100% and/or introduces one or more elements of instability that involve the user's core muscles, as explained in greater detail below.

Figure 1:
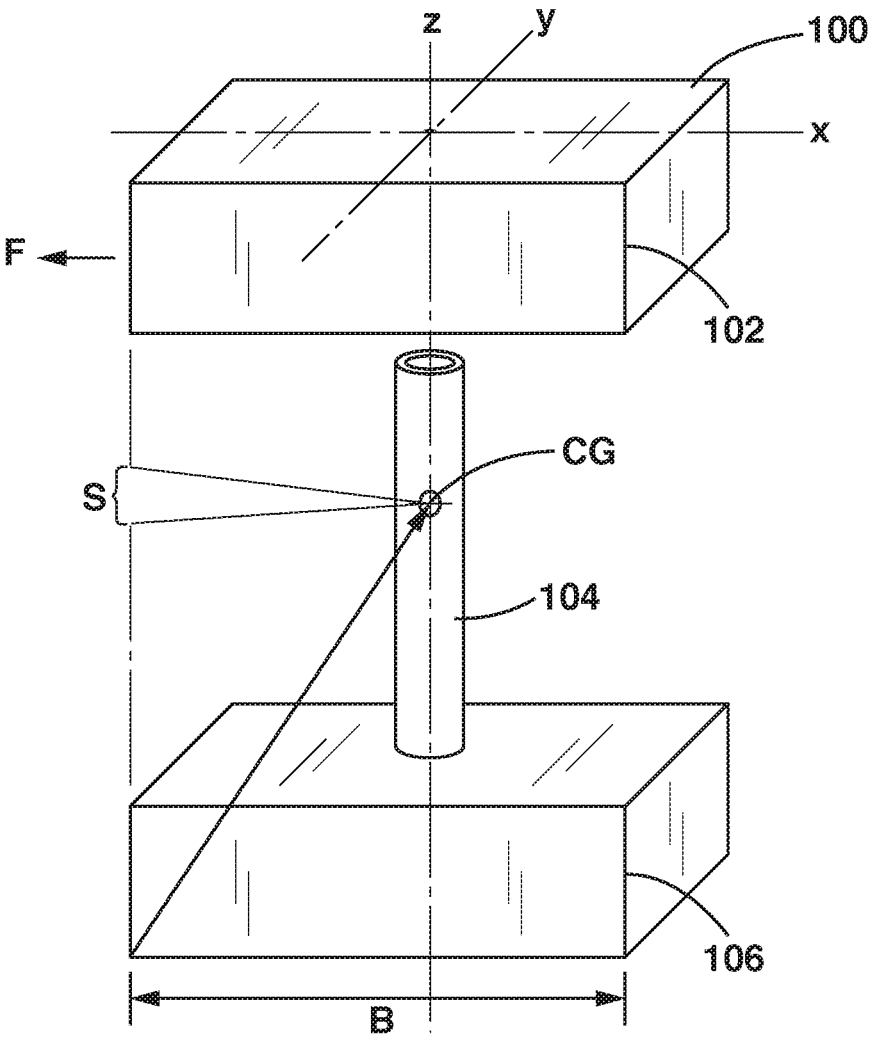
FIG. 1 is a perspective view depicting the components of an core muscle exercise system (in block form) according to at least one embodiment of the systems disclosed in the present application.

Referring to FIG. 1, the exercise system 100, includes a top element 102 and a bottom element 106, interconnected with middle element 104. The elements may be fixed with each other or preferably removable attachable to each other, as explained below. With regard to the latter, the system 100 may be provided as a modular kit with interchangeable components, each varying the degree of instability of the exercise system 100. For example, a first lower component 106 may have a planar interface with the ground with a certain instability associated therewith as a function of the characteristics of the contact area with the ground and the center of gravity of the system (e.g., FIG. 3E generally considered stable at equilibrium), whereas as a second lower component 106 may have a pivotal interface with the ground with a higher degree of instability (e.g., FIGS. 3A-3D generally considered unstable at equilibrium).

Figure 5:
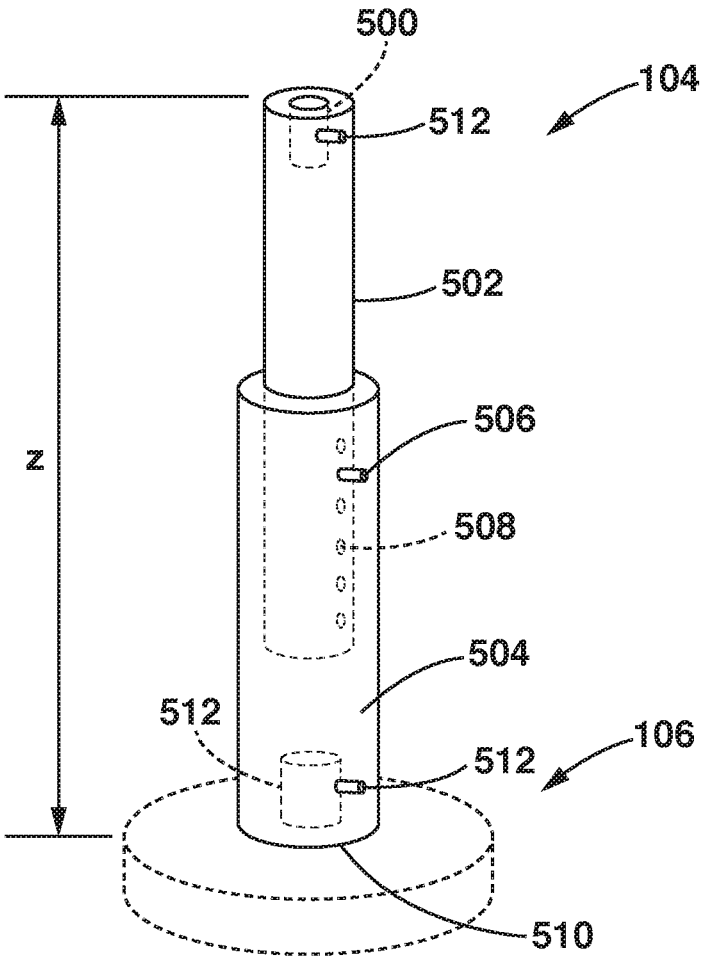
FIG. 5 is a perspective view depicting an intermediate component of the core muscle exercise system(s) disclosed herein.

Referring to FIG. 2, the exercise system 100 may be used to perform a modified plank. As can be seen, the system 100 is placed between the user and the ground to elevate the user a distance Z therefrom. This elevation Z varies the bodyweight acting orthogonal to the user's back ($W_o$). That is, varying Z will vary the angle of inclination a and will correspondingly vary $W_o$. In other words, $W_o$ is a function of Z and $\alpha$. In this regard, Z may be sufficiently tall so that the user is nearly upright or standing in which instance $W_o$ will be about 0% of the user's weight W. Similarly, Z may be sufficiently low so that $W_o$ is about 100% of the user's weight W. The exercise system 100 is preferably adjustable to vary the elevation of the system Z, such as with an adjustable middle element 104 as shown in FIG. 5. As can be appreciated, a user with minimal fitness or function as a result of, e.g., a back injury can begin core exercises with the adjustable middle element 104 in the highest position for the particular user. This will allow the user to involve some of the core muscles at least minimally without overstressing the back muscles. As the user progresses, the middle element 104 may be lowered to involve more of the core muscles (including the back). Although the present system is discussed in relation to back injury, it is understood that any injury or limitation may be addressed with the presently disclosed system, including without limitation hip, knee, shoulder, neck, and a myriad foot problems.

As indicated above, varying degrees of instability may be used alone or with the variable elevation Z to involve more of the user's core muscles. This generally entails selecting a top and/or bottom element 102, 106 with the desired instability. For example, a user may set up the system 100 initially at the highest elevation Z and a relatively stable bottom element 106 (e.g., FIG. 3E). In this instance, some of the user's weight will involve essentially on the deltoid, trapezius, and/or latissimus dorsi muscles (not unlike the use of a walker type assistive device). As the user progresses, the stable bottom element 106 may be replaced with an unstable bottom element 106 (e.g., FIGS. 3A-3D). Even though upright, the instability in the bottom element 106 may require the user to balance the system 100 thereby involving more core muscles, such as the obliques. As the user progresses even further, additional instability and/or resistance may be added by, for example, varying the stability with regard to the bottom element 106, top element 102 and/or lowering the elevation Z via middle element 104.

Figure 3A:
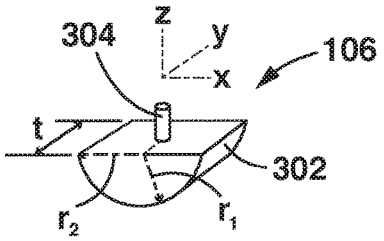
FIGS. 3A-3F depict various embodiments of a base component of the core muscle exercise system(s) disclosed herein.
Figure 3B:
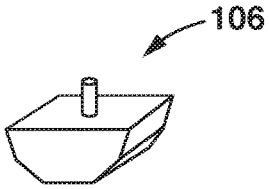
Figure 3C:
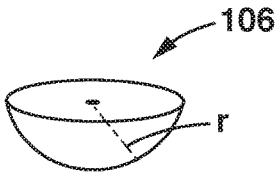
Figure 3D:
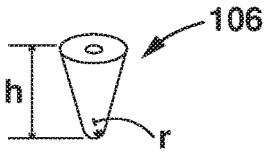
Figure 3E:
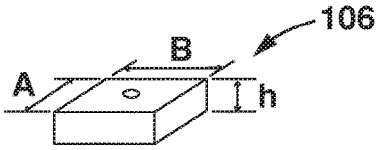

Referring to FIGS. 3A-3F, exemplary bottom elements 106 with varying instability are shown. The bottom element 106 generally has a structure 302 with a mechanism 304 for removably attaching the middle element 104 thereto. This may simply include a post that is received within an aperture and selectively affixed to the middle element 104 (show in in FIG. 5). Although shown centrally disposed on the bottom element 106, the attachment mechanism may be offset to provide different left vs. right and fore vs. aft stability. As indicated above, the bottom element 106 may be stable at equilibrium. That is, the system 100 will tend to tilt with the application of a force F and return back to the original position with the removal of that force, as shown in FIG. 1. As also shown in FIG. 1, the center of gravity (CG) of the system 100 in the stable embodiment will rise a distance S along the z-axis in an orthogonal reference system as the system 100 tilts. The distance S is a function of the base B. In this regard, the magnitude of S is representative of the relative stability of the system 100. Referring to FIG. 3E, the stable base may be a square (A=B) or a rectangle (A>B). With regard to the latter, the stable base will have different instability with regard to tilting about the x-axis of the orthogonal reference system as compared to the instability about the y-axis of the orthogonal system (i.e., $S_A>S_B$). With an offset attachment mechanism 304 having an offset toward the right side or toward the front of the bottom element 106, the stability can be represented as $S_{AL}>S_{AR}$ and $S_{AR}>S_{AF}$, respectively.

Figure 3F:
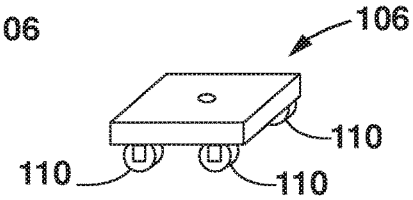

Referring to FIG. 3A, the bottom element may be stable in one plane and unstable in another plane. That is, the distance S may be greater than zero relative to tilting about the x-axis (where S is a function oft) and zero relative to in the y-axis (i.e., no rise in the z-axis by the CG as the system tilts about the y-axis). The shape of the unstable face of the bottom element 106 may be circular or elliptical (FIG. 3A $r_1=r_2$ or $r_1<r_2$, respectively), a polygon (FIG. 3B), etc. The bottom element 106 may be unstable about both the x-axis and y-axis (as show in FIGS. 3C (semi-spherical/ellipsoidal) and 3D (conical with or without a semi-spherical/ellipsoidal tip). In at least one embodiment, the system 100 is made less stable with the additions of wheels or casters that allow the system 100 to roll in one or a plurality of directions (FIG. 3F). In this regard, the wheels or casters may have a locking mechanism that restricts all or some movement in or a plurality of the wheels or casters.

Figure 4:
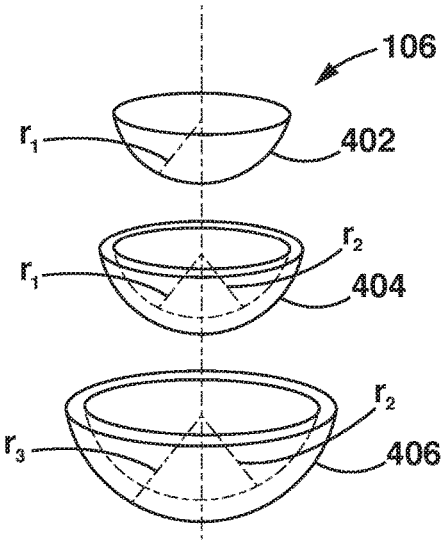
FIG. 4 depict another embodiment of a base component of the core muscle exercise system(s) disclosed herein.

Referring to FIG. 4, the bottom element 106 itself may have an adjustable stability. That is, the stability of the bottom element 106 may vary by adjustably increasing the footprint or contact area of the unstable bottom element 106. In one embodiment, this is achieved with a semi-spherical/ellipsoidal bottom element 402 with attachments 404, 406 that fit over the bottom element 402 to effectively increase the radius from $r_1$-$r_3$. The contact area may also be increased/decreased with an inflatable bottom element 106 by varying the pressure within the bottom element 106. That is, lower pressure will increase the contact area with the ground and correspondingly provide more grip thereby stabilizing the system 100. Increasing pressure will reduce the contact area thereby decreasing the stability of the system 100. Stability may also be varied by lowering or raising the center of gravity of the system 100. This can be achieved with lighter and/or heavier top and/or bottom elements.

Figure 8:
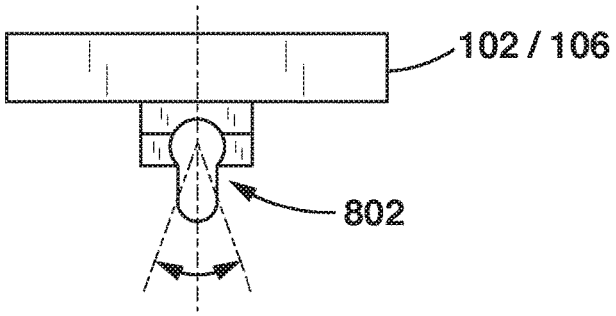
FIG. 8 depicts a representative mechanism for interconnecting core muscle system components.

Referring to FIG. 5, in at least one embodiment, the middle element 104 is adjustable to vary the height Z of the system 100. This may be achieved various ways, including a telescopic arrangement, as shown, having an inner member 502 slidingly and adjustably coupled to an outer member 504. The inner and outer members may be fixed relative to each other via pin or button 506 that engage apertures 508. The middle element 104 preferably includes a top attachment mechanism for removably attaching the middle element 104 to the top element 102, and a bottom mechanism 510 for removably attaching the middle element 104 to the top element 102. As indicated elsewhere, this detachability may be achieved with a post that fits into apertures 500, 510 in the middle element 104 and affixed thereto via one or more pins or other locking mechanism 512. The top and/or bottom elements may be attached via swivel connections 802 (FIG. 8) to the middle element 104. The swivels may allow pivotal movement in various degrees of freedom, including pivoting left and right, and fore and aft, and rotational movement about the middle element 104 axis. The system 100 may include a mechanism to lock or otherwise prevent one or a plurality of these movements.

Figure 6A:
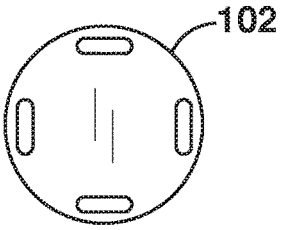
FIGS. 6A-C depict various embodiments of a top component of the core muscle exercise system(s) disclosed herein.
Figure 6B:
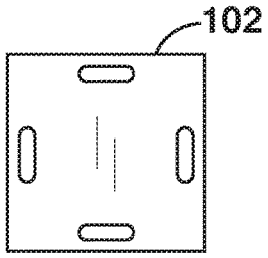
Figure 6C:
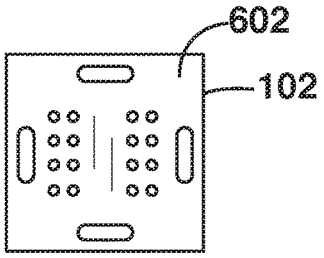

Referring to FIGS. 6A-6C, various embodiment of the top element 102 are shown. The top element 104 is generally an item that provides an interface for the user to hold or rest on the top element, such as a platform with a plurality of handles. The platforms may be any shape, including circular, square, rectangular, etc. The platforms 102 may further include means for attaching accessories thereto. For instance, the platform may include one or more, or preferably a plurality of rows of accessory apertures 602 for releasably attaching accessories to the top of the platform 102. The apertures rows 602 are preferably aligned and parallel to accommodate various sized users. The spacing may also be used to target different core muscles or core muscles from different directions.

Figure 7:
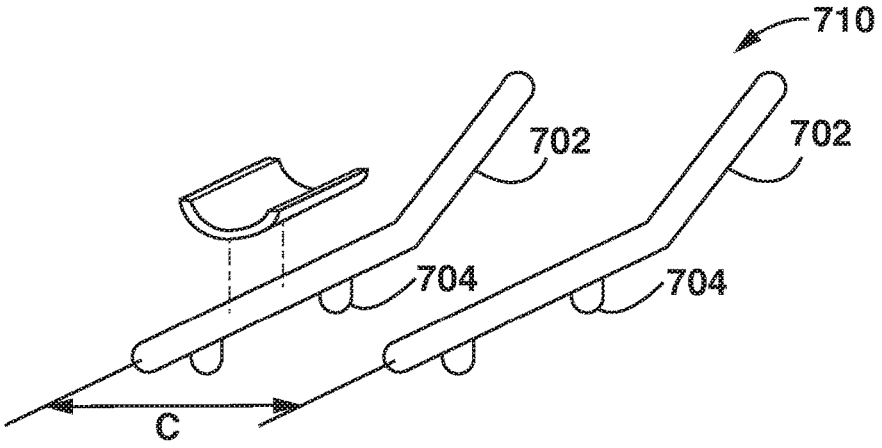
FIG. 7 is a perspective view depicting an accessory attachable to the top component of the core muscle exercise system(s) disclosed herein.

Referring to FIG. 7, an accessory 700 for use with the top element 104 includes one or preferably a plurality of forearm rests 702. These rests include pegs 704 that engage the apertures 602. As can be appreciated, users may insert the pegs 704 offset relative to the center of the platform. For instance, the accessories may be offset toward the front, which will create a different stability in the system 100 by correspondingly offsetting the center of gravity of the system 100 in use. Similarly, the accessories may be spaced apart laterally to increase the leverage by the user against the instability of the system 100.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. An exercise system enabling a user to perform therewith a modified plank exercise, the exercise system comprising:

a top element having an interface for the user to hold or rest thereon, wherein the top element comprises a platform with means for attaching one or plural accessories to the platform;

a bottom element having an interface with a ground surface, the top and bottom elements interconnected and separated from each other with a middle element having a variable height, the exercise system configured therewith for the user to adjust the exercise system between at least a first position in which about 0% of the user's body weight is orthogonal to the user's back in usage of the exercise system and a second position in which about 100% of the user's body weight is orthogonal to the user's back in usage of the exercise system, the top element being pivotally coupled to the middle element with a swivel that allows the top element to pivot relative to the middle element in left and right directions, and in fore and aft directions; and a lock that prevents the top element from pivoting relative to the middle element in at least one of the left and right directions, and the fore and aft directions, wherein at least one of the top and bottom elements is interchangeably coupled to the middle element, and wherein the top and bottom elements each include one or plural elements of instability that are unstable at equilibrium and configured to be overcome by involving core muscles of the user, and wherein the top and bottom elements are both unstable at equilibrium.

2. The exercise system of claim 1, wherein the middle element is telescopically coupled to the top and bottom elements to adjustably separate the top and bottom elements from each other between the first position and the second position.

3. The exercise system of claim 1, wherein the exercise system is provided as a modular kit with interchangeable components that vary a degree of instability of the exercise system, wherein the interchangeable components are selected from a group comprising the bottom element and the one or plural elements of instability.

4. The exercise system of claim 3, wherein the modular kit comprises a first modular element and a second modular element, wherein the first modular element has an instability that is different than an instability of the second modular element, and wherein the first and second modular elements are interchangeable components selected from the group comprising the bottom element and the one or plural elements of instability.

5. The exercise system of claim 4, wherein the first modular element is stable at equilibrium and wherein the second modular element is unstable at equilibrium.

6. The exercise system of claim 4, wherein the second modular element has a pivotal interface with the ground surface.

7. The exercise system of claim 4, wherein the first modular element has a semi-spherical or ellipsoidal shape.

8. The exercise system of claim 4, wherein the first modular element has a conical shape.

9. The exercise system of claim 4, wherein the first modular element is stable at equilibrium in a first axis of an orthogonal plane and unstable at equilibrium in a second axis of the orthogonal plane.

10. The exercise system of claim 4, wherein the first modular element has a semi-spherical or ellipsoidal shape interfacing with the ground surface.

11. The exercise system of claim 1, wherein the one or plural elements of instability comprise one or plural wheels or casters disposed at the bottom element.

12. The exercise system of claim 1, wherein the top element comprises a platform with a plurality of handles located thereon.

13. The exercise system of claim 1, wherein the means for attaching the one or plural accessories to the platform enables the one or plural accessories to be adjustably coupled to the platform.

14. An exercise system enabling a user to perform therewith a modified plank exercise, the exercise system comprising:

a top element having an interface for the user to hold or rest thereon, wherein the top element comprises an element of instability that is unstable at equilibrium and a platform with means for attaching one or plural accessories to the element; and a plurality of bottom elements each having an interface with a ground surface and being unstable at equilibrium, the top element and the plurality of bottom elements interchangeably interconnectable to a telescopic middle element, the telescopic middle element having a variable height and configured therewith for the user to adjustably separate the top element and at least one of the plurality of bottom elements from the top element between at least a first position in which about 0% of the user's body weight is orthogonal to the user's back in usage of the exercise system and a second position in which about 100% of the user's body weight is orthogonal to the user's back in usage of the exercise system, the top element being pivotally coupled to the telescopic middle element with a swivel that allows the top element to pivot relative to the telescopic middle element in left and right directions, and in fore and aft directions; and a lock that prevents the top element from pivoting relative to the telescopic middle element in at least one of the left and right directions, and the fore and aft directions, wherein a first of the plurality of bottom elements has an instability that is different than an instability of a second of the plurality of bottom elements.

15. An exercise system enabling a user to perform therewith a modified plank exercise, the exercise system comprising:

a top element having an interface for the user to hold or rest thereon;

a telescopic middle element pivotally coupled at a top end of the telescopic middle element to the top element, wherein the top element is unstable at equilibrium and the top element is pivotally coupled to the telescopic middle element with a swivel that allows the top element to pivot relative to the telescopic middle element in left and right directions, and in fore and aft directions;

a plurality of bottom elements each having an interface with a ground surface, the plurality of bottom elements interchangeably interconnectable to the telescopic middle element, the telescopic middle element having a variable height and configured therewith for the user to adjustably separate the top element and at least one of the plurality of bottom elements from the top element between at least a first position in which about 0% of the user's body weight is orthogonal to the user's back in usage of the exercise system and a second position in which about 100% of the user's body weight is orthogonal to the user's back in usage of the exercise system; and a lock that prevents the top element from pivoting relative to the telescopic middle element in at least one of the left and right directions, and the fore and aft directions, wherein a first of the plurality of bottom elements has an instability that is different than an instability of a second of the plurality of bottom elements, and wherein at least one of the first and the second bottom elements is unstable at equilibrium.

16. The exercise system of claim 15, wherein the first of the plurality of bottom elements has a planar interface with the ground surface and the second of the plurality of bottom elements has a curved interface with the ground surface.

17. The exercise system of claim 15 wherein one of the plurality of bottom elements includes an element of adjustable instability that adjusts an amount of surface area of the one of the plurality of bottom elements that is in contact with the ground surface based on an amount of pressure within the one of the plurality of bottom elements.

* * * * *